US006659024B1

(12) United States Patent
Gengo et al.

(10) Patent No.: US 6,659,024 B1
(45) Date of Patent: Dec. 9, 2003

(54) POWDERY FUEL COMBUSTION APPARATUS

(75) Inventors: Tadashi Gengo, Tokyo (JP); Kouichi Sakamoto, Tokyo (JP); Masashi Hishida, Tokyo (JP); Tomomitsu Yokoyama, Tokyo (JP); Akiyasu Okamoto, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/402,859

(22) PCT Filed: Feb. 16, 1998

(86) PCT No.: PCT/JP98/00621

§ 371 (c)(1),
(2), (4) Date: Oct. 13, 1999

(51) Int. Cl.[7] ..... F23D 1/00

(52) U.S. Cl. ..... 110/263; 110/260; 110/261; 110/265; 110/104 B; 110/347

(58) Field of Search ..... 110/260, 261, 110/263, 265, 347, 104 B, 101 R, 182.5; 431/173; 239/399, 403

(56) References Cited

U.S. PATENT DOCUMENTS

| | | | | | |
|---|---|---|---|---|---|
| 728,459 | A | * | 5/1903 | Harrison | 110/260 |
| 2,329,468 | A | * | 9/1943 | Hardgrove | 110/104 |
| 2,515,813 | A | * | 7/1950 | Wiant | 110/344 |
| 3,391,675 | A | * | 7/1968 | Hoare | 110/260 |
| 3,834,858 | A | * | 9/1974 | Krippene et al. | 431/279 |
| 4,492,171 | A | * | 1/1985 | Brashears et al. | 110/261 |
| 4,598,862 | A | * | 7/1986 | Rice | 239/8 |
| 5,070,797 | A | * | 12/1991 | Rietzscher et al. | 110/106 |
| 5,107,776 | A | * | 4/1992 | Garcia-Mallol | 110/264 |
| 5,727,480 | A | * | 3/1998 | Garcia-Mallol | 110/203 |

FOREIGN PATENT DOCUMENTS

| | | | | |
|---|---|---|---|---|
| GB | 720666 | * | 12/1954 | 110/260 |
| JP | 60-140017 | * | 7/1985 | 110/260 |
| SU | 817-385 | * | 3/1981 | 110/261 |

* cited by examiner

*Primary Examiner*—Denise L. Ferensic
*Assistant Examiner*—Ken Rinehart
(74) *Attorney, Agent, or Firm*—Wenderoth, Lind & Ponack, L.L.P.

(57) ABSTRACT

A powdery fuel combustion apparatus disposed on furnace side plane (7) of vertical square body type furnace in which a vertical plane passing through a fuel jetting directional axis (8) does not cross the furnace side plane orthogonally, and thus the workability of furnace wall tubes and burner panel, and the maintainability of burner nozzle are improved. The apparatus includes a burner nozzle (1) that is formed such that the nozzle has right and left non-symmetrical shapes, with respect to a vertical plane passing through axis (8). Also, the nozzle has a tip portion opening lying in an opening plane (2) which coincides or is parallel to the furnace side plane (7).

8 Claims, 9 Drawing Sheets

POWDERY FUEL COMBUSTION APPARATUS

BACKGROUND OF THE INVENTION

1. Field of the Invention

The present invention relates to a powdery fuel combustion apparatus applicable to a thermal power generation boiler furnace, a chemical industry furnace and the like.

2. Description of the Prior Art

FIG. 7 is a horizontal cross sectional view showing one example of a prior art powdery fuel combustion apparatus. In FIG. 7, numeral 1 designates a burner nozzle, numeral 2 designates a burner nozzle opening plane, numeral 3 designates a powdery fuel supply pipe, numeral 4 designates a combustion assisting air supply passage, numeral 5 designates a wind box, numeral 6 designates a multiplicity of furnace wall tubes, numeral 7 designates a furnace side plane and numeral 11 designates an extension plane of the furnace side plane 7.

A mixed flow of a powdery fuel and a carrying air passes through the powdery fuel supply pipe 3 to be led to the burner nozzle 1 to be then jetted into a furnace from the burner nozzle opening plane 2. Combustion assisting air passes through the combustion assisting air supply passage 4 to be led to the burner nozzle 1 to be then jetted into the furnace from the burner nozzle opening plane 2, like the mixed flow of the powdery fuel and the carrying air. A jetting directional axis 8 is a central axis extending along the direction of the jetting of the fuel and air and a vertical plane passing through the jetting directional axis 8 does not intersect the furnace side plane 7 orthogonally but at an angle.

The jetted powdery fuel and carrying air as well as the combustion assisting air, while they are diffusing and mixing with one another, form flames. At this time, if there occurs such a phenomenon that the flames impinge on the furnace wall tubes 6 or lick on the furnace wall tubes 6, the flames will be cooled by the furnace wall tubes 6, which may result in a deterioration of combustibility due to an increase of combustibles in ash or in what is referred to as clinker trouble in which clinker sticks to the furnace wall tubes 6.

Thus, in the prior art, in order to prevent the flames from impinging on the furnace wall tubes 6, a portion of the furnace wall tubes 6 near the burner nozzle 1 is not arranged in the extension plane 11 of the furnace side plane 7 but is arranged in a row toward the wind box 5 side, as shown by a row 26 of the furnace wall tubes 6, in consideration of flame spreading, wherein an angle $\alpha$ is formed between the furnace side plane 7 and the row 26 of the furnace wall tubes 6.

A jetting directional axis along which the combustion assisting air is jetted into the furnace is coaxial with the jetting directional axis 8 along which the powdery fuel and the carrying air are jetted into the furnace. Also, a cross sectional shape of the burner nozzle 1 is a right and left plane symmetric shape, where a vertical plane passing through the jetting directional axis 8 is the symmetry plane.

FIG. 8 is what is called a burner panel structure conceptual view (plan view), wherein a conceptual view of the structure of the furnace wall tubes 6 arranged around the prior art powdery fuel combustion apparatus of FIG. 7 is shown. Each line element shown in FIG. 8 represents one of the furnace wall tubes 6.

In the prior art powdery fuel combustion apparatus mentioned above, in consideration of preventing increased combustibles in ash or preventing clinker trouble, the partial furnace wall tubes 6 near the burner nozzle 1 are arranged in the row 26 toward the wind box 5 side with the angle $\alpha$ between the furnace side plane 7 and the row 26 and this arrangement is considered sufficient performance-wise. However, there are still problems to be improved structurally, as follows:

(1) The row 26 portion of the furnace wall tubes 6 is not located in the same plane as the furnace side plane 7 or the extension plane 11 of the furnace side plane 7, hence the work of a furnace wall tube panel or a burner panel is not facilitated.

(2) A furnace wall support structure becomes complicated.

(3) In the case of a large capacity burner or a large capacity boiler, a length L of the row 26 of the furnace wall tubes 6 becomes large relative to a furnace width or a furnace depth, hence access to the surroundings of the furnace wall becomes difficult which inconveniences the maintenance of the furnace.

(4) The burner nozzle 1 is located on a comparatively outer side of the furnace, hence maintainability thereof is not high.

SUMMARY OF THE INVENTION

In order to solve the problems in the prior art, the inventors here disclose a powdery fuel combustion apparatus comprising a burner nozzle, disposed on a furnace side plane of a vertical square body type furnace, for jetting a mixed flow of a powdery fuel and air as well as a combustion assisting air therearound. A powdery fuel supply pipe, connected to said burner nozzle, is provided for supplying the powdery fuel and air. Also, a wind box is connected to the burner nozzle via the powdery fuel supply pipe and forms a combustion assisting air supply passage disposed around the powdery fuel supply pipe. The powdery fuel combustion apparatus is constructed such that a vertical plane passing through a jetting directional axis of the mixed flow does not cross the furnace side plane orthogonally. The burner nozzle has a right and left non-symmetric shape with respect to the vertical plane and has its tip portion opening plane located in a plane which is same as or parallel to the furnace side plane.

In the powdery fuel combustion apparatus of the present invention constructed as above, the burner nozzle has a right and left non-symmetric shape with respect to the vertical plane passing through the jetting directional axis of the mixed flow of the powdery fuel and air. The nozzle has its tip portion opening plane located in the plane which is same as or parallel to the furnace side plane, and thus the mixed flow of the powdery fuel and carrying air as well as the flow of the combustion assisting air, both jetted from the burner nozzle opening plane, can form flames in a more inner side place of the furnace than in a place at the furnace side plane and extension plane thereof or near these planes. Hence, such a phenomenon that the flames impinge on the furnace wall tubes or lick on the furnace wall tubes can be prevented and also the partial furnace wall tubes located near the burner nozzle are arranged on the furnace side plane, thereby the structural portions of the furnace and the like can be simplified.

Also, the present invention provides a powdery fuel combustion apparatus as mentioned above, wherein there are provided a swirler type disperser in a bent portion of the powdery fuel supply pipe or on a burner nozzle side of the bent portion as well as provided a rich/lean separator near the burner nozzle in the powdery fuel supply pipe.

That is, the powdery fuel, which has been carried by the carrying air in the powdery fuel supply pipe from the upstream side, is dispersed by the swirler type disperser located in the bent portion or on the burner nozzle side of the bent portion so that the distribution thereof becomes uniform and then the mixed flow of the powdery fuel and the air is separated into a fuel rich portion and a fuel lean portion by the rich/lean separator to be jetted into the furnace. Thereby the fuel separated into the rich/lean portions is supplied into the furnace so that a combustion in which NOx is reduced can be effected.

Further, the present invention provides a powdery fuel combustion apparatus as mentioned above, wherein the wind box constitutes a unit wind box comprising two powdery fuel supply pipes and five combustion assisting air supply passages. One of the supply passages is disposed between the two powdery fuel supply pipes and four being disposed so as to open in a double form, respectively, around each of the two powdery fuel supply pipes and there are provided a plurality of the unit wind boxes.

That is, according to the present invention, the unit wind box is constructed such that the powdery fuel supply pipe is separated into two parts and the combustion assisting air supply passage is separated into five parts and there are provided the plurality of the unit wind boxes. Thereby the supply of the powdery fuel and the combustion assisting air can be controlled finely and a timely control of the combustion becomes possible so that an optimum combustion state may be obtained.

Also, the present invention provides a powdery fuel combustion apparatus as mentioned above, wherein a jetting portion for jetting the combustion assisting air into the furnace is constructed by a burner throat in place of the burner nozzle.

That is, according to the present invention, out of the mixed flow of powdery fuel and air and the combustion assisting air which are to be supplied into the furnace, the combustion assisting air is supplied not through the burner nozzle but through the burner throat, thereby the construction of the jetting portion of the combustion assisting air which tends to become complicated can be further simplified.

DESCRIPTION OF THE PREFERRED EMBODIMENTS

Figure 1:
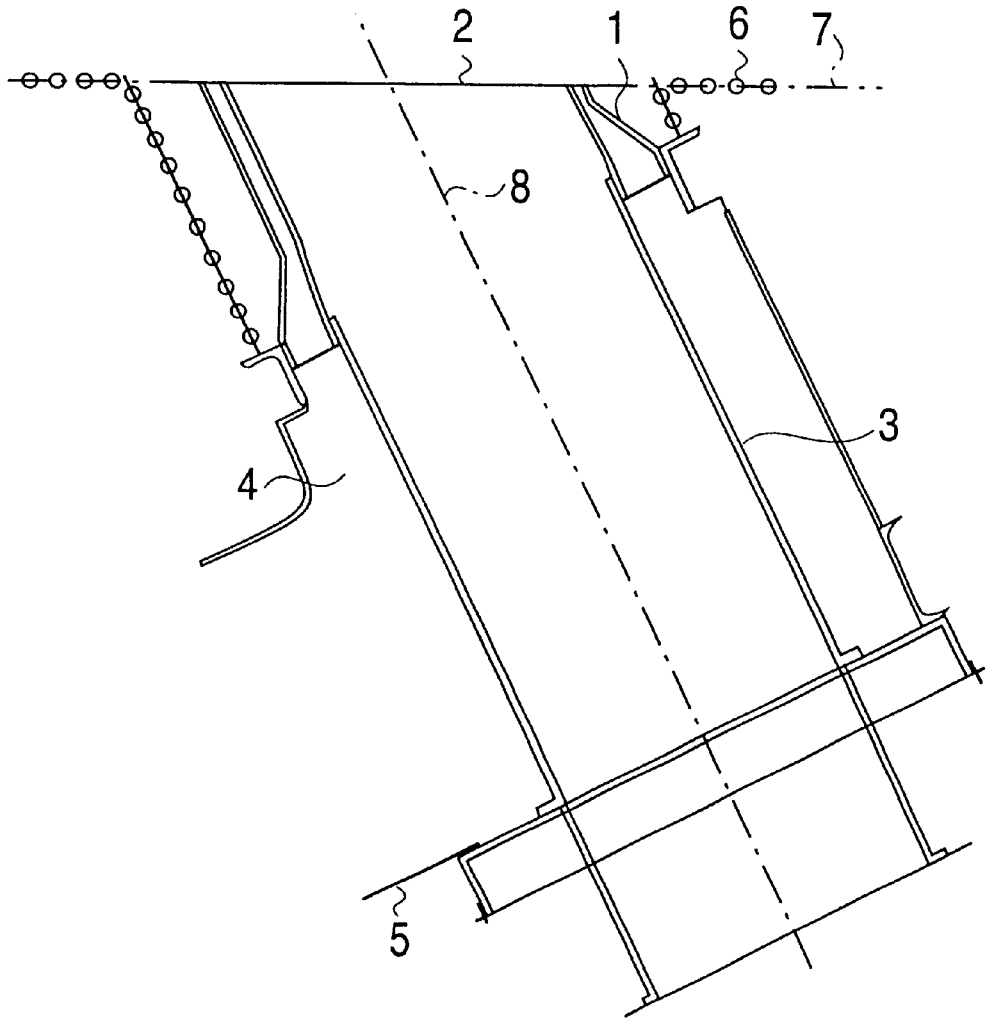
FIG. 1 is a horizontal cross sectional view of a powdery fuel combustion apparatus of a first embodiment according to the present invention.

FIG. 1 is a horizontal cross sectional view of a powdery fuel combustion apparatus of a first embodiment according to the present invention. In FIG. 1, numeral 1 designates a burner nozzle, numeral 2 designates a burner nozzle opening plane, numeral 3 designates a powdery fuel supply pipe, numeral 4 designates a combustion assisting air supply passage, numeral 5 designates a wind box, numeral 6 designates a multiplicity of furnace wall tubes and numeral 7 designates a furnace side plane.

A jetting directional axis 8 along which a powdery fuel and a carrying air are jetted into a furnace is coaxial with a jetting directional axis along which combustion assisting air is jetted into the furnace and a vertical plane passing through the jetting directional axis 8 is not orthogonal but inclined relative to the furnace side plane 7. The burner nozzle 1 is of a right and left non-symmetric shape, which is different from the prior art case shown in FIG. 7, with respect to a vertical plane passing through the jetting directional axis 8.

By employing such a shape, the burner nozzle opening plane 2 can be located in the same plane as the furnace side plane 7 and even if the partial furnace wall tubes are not arranged in a row toward a wind box side with an angle to the furnace side plane 7 as in the prior art case, combustion can be effected without the occurrence of a phenomenon that flames impinge on the furnace wall tubes 6 or lick on the furnace wall tubes 6.

It is to be noted that although the illustration shows a case where the burner nozzle opening plane 2 is located in the same plane as the furnace side plane 7, the burner nozzle opening plane 2 may also be located in a plane which is near and parallel to the furnace side plane 7.

Figure 2:
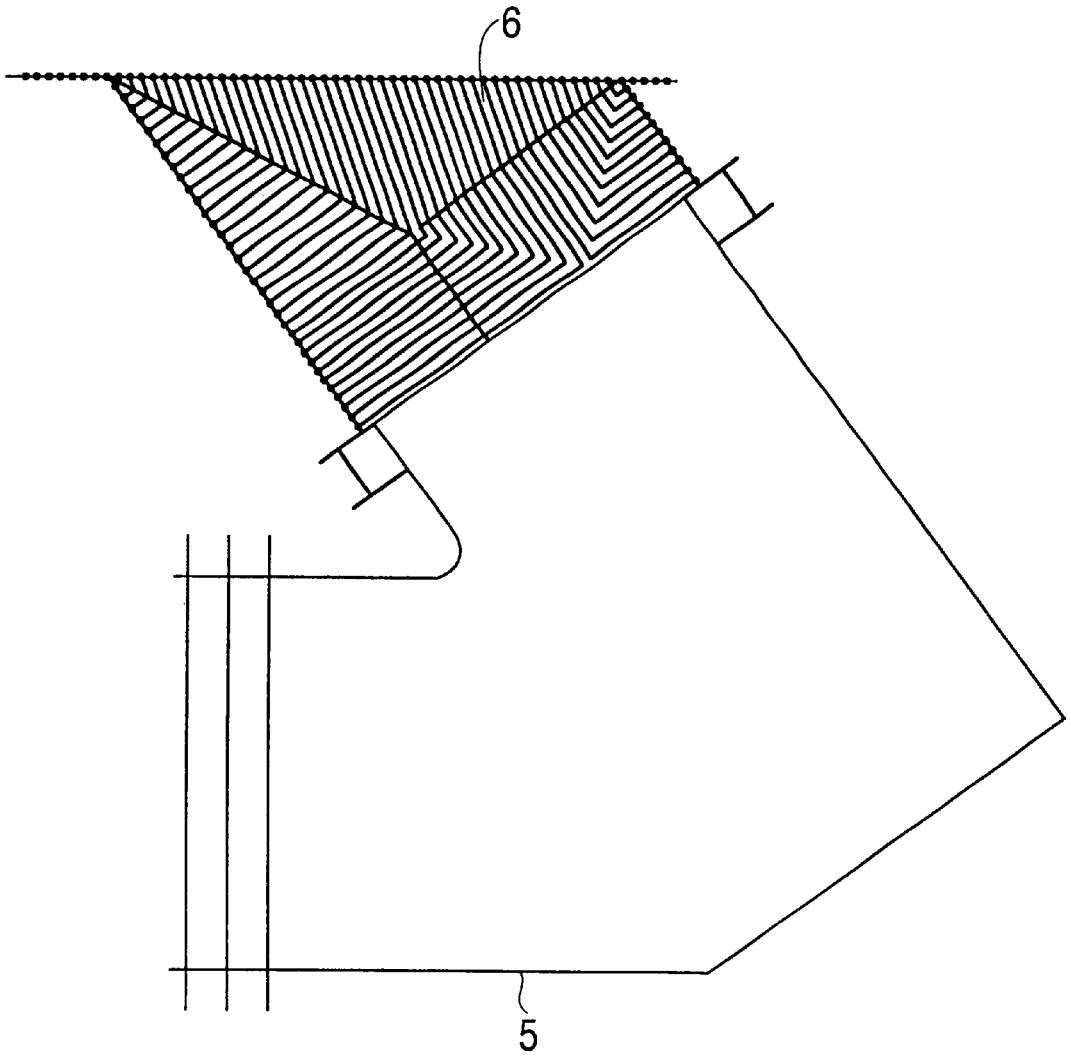
FIG. 2 is a conceptual view of a furnace wall tube structure of the first embodiment of FIG. 1.
Figure 8:
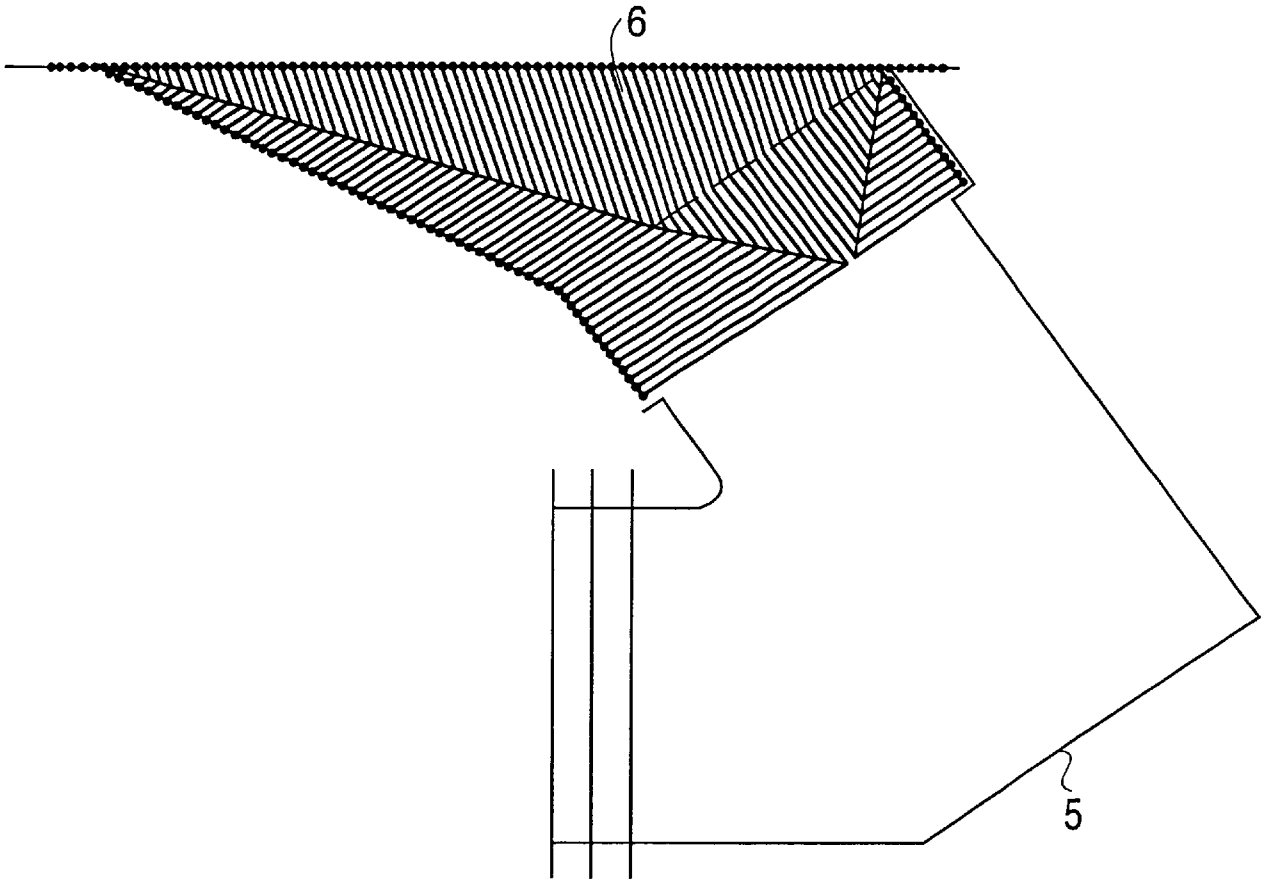
FIG. 8 (PRIOR ART)
FIG. 8 is a conceptual view of a furnace wall tube structure of the prior art powdery fuel combustion apparatus of FIG. 7.

FIG. 2 is what is called a burner panel structure conceptual view (plan view), wherein a conceptual view of the structure of the furnace wall tubes 6 arranged around the powdery fuel combustion apparatus of the first embodiment is shown. As compared with the prior art case shown in FIG. 8, it is understood that the burner panel structure can be simplified remarkably by the present invention.

Figure 3A:
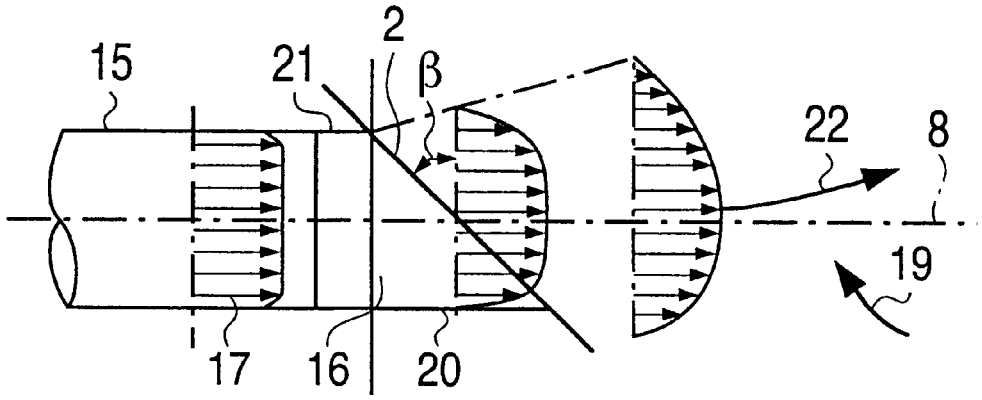
FIGS. 3(*a*)–3(*b*) are explanatory views showing schematically a flow state near a burner portion in the first embodiment of FIG. 1 and in the prior art of FIG. 7, wherein FIG. 3(*a*) is of the first embodiment and FIG. 3(*b*) is of the prior art.
Figure 3B:
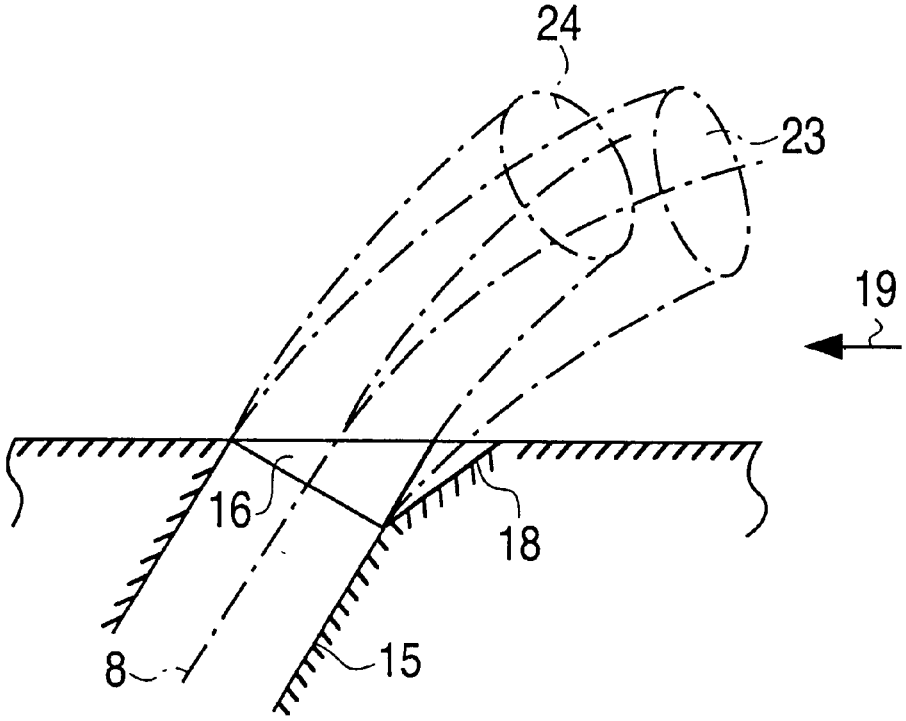
Figure 7:
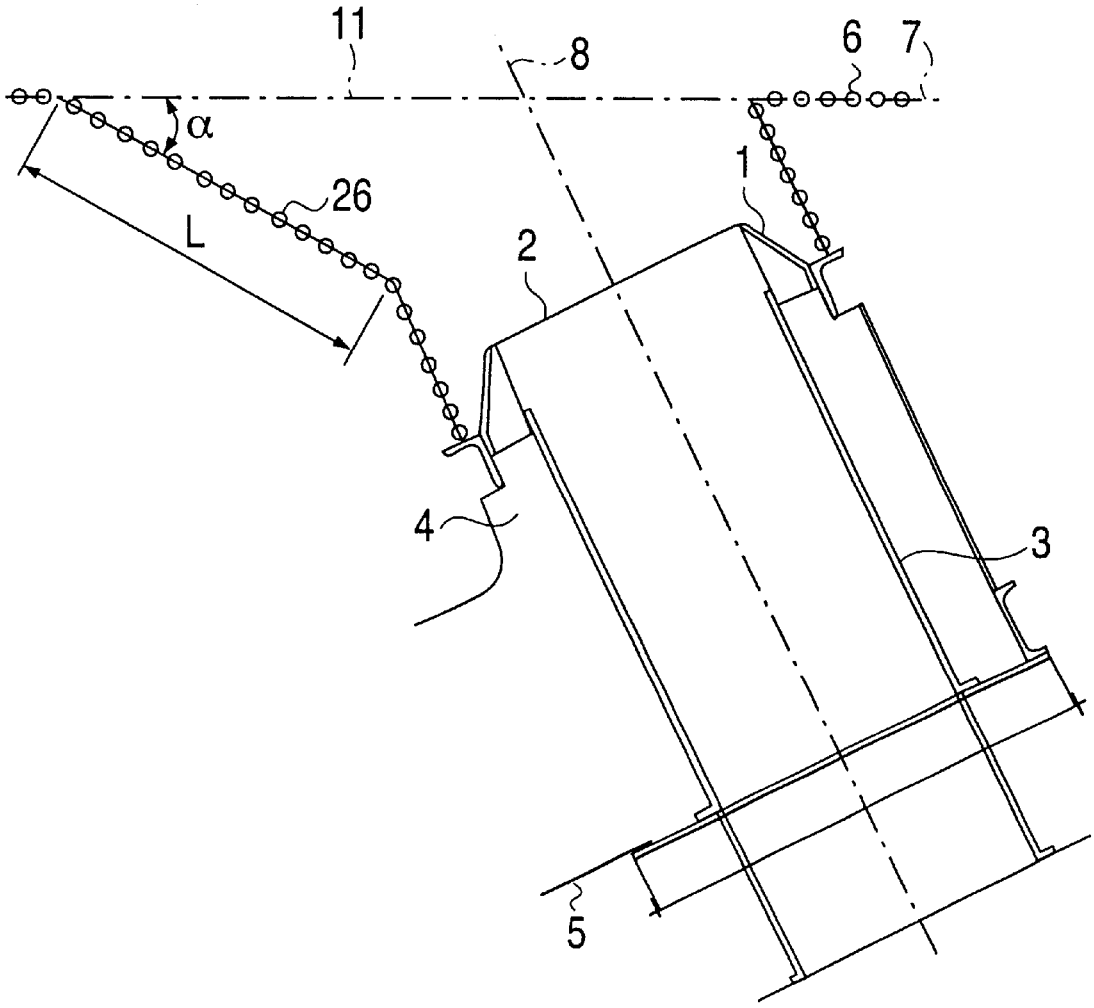
FIG. 7 (PRIOR ART)
FIG. 7 is a horizontal cross sectional view of one example of a prior art powdery fuel combustion apparatus.

FIGS. 3(*a*)–3(*b*) are explanatory views showing schematically a flow state near a burner portion in the first embodiment of FIG. 1 and in the prior art of FIG. 7, wherein FIG. 3(*a*) is of the first embodiment and FIG. 3(*b*) is of the prior art. In FIGS. 3(*a*)–3(*b*), numeral 15 shows schematically the powdery fuel supply pipe or the combustion assisting air supply passage, numeral 16 shows schematically the burner nozzle and arrow 19 shows the direction of swirling flames in the furnace. Arrows 17 in FIG. 3(*a*) show a jetting directional velocity distribution of the powdery fuel and the carrying air or the combustion assisting air jetted into the furnace. Numeral 18 in FIG. 3(*b*) shows the row of furnace wall tubes arranged toward the wind box side with the angle $\alpha$ to the furnace side plane.

The powdery fuel combustion apparatus of the present embodiment is basically different from the prior art burner in the flow characteristics near the burner portion.

That is, as shown in FIG. 3(*a*), in the present embodiment where the burner nozzle opening plane 2 forms an angle $\beta$ with respect to a vertical plane orthogonal to the jetting directional axis 8 along which the powdery fuel and the carrying air are jetted into the furnace, there occurs a larger pressure loss of jet flow on a burner nozzle wall surface 20 on which a jet flow passage of the powdery fuel and the carrying air or the combustion assisting air becomes longer than on a wall surface on the opposite side, that is, on a burner nozzle wall surface 21 on which the jet flow passage of the powdery fuel and the carrying air or the combustion assisting air becomes shorter.

Thus, if comparison is made between the former burner nozzle wall surface 20 side and the latter burner nozzle wall surface 21 side, the latter burner nozzle wall surface 21 side is stronger than the former burner nozzle wall surface 20 side in the penetration and diffusion in the furnace of the jet flow of the powdery fuel and the carrying air or the combustion assisting air.

In addition to this state of phenomenon of the penetration and diffusion, the swirling flames 19 in the furnace act thereon and the direction of the jet flow of the powdery fuel and the carrying air or the combustion assisting air is biased to the burner nozzle wall surface 21 side, as shown by arrow 22, deviating from the jetting directional axis 8. Degree of the biasing in this case depends on the angle β and a frictional resistance coefficient of the burner nozzle wall surface 20, 21.

On the other hand, as shown in FIG. 3(*b*), in the prior art powdery fuel combustion apparatus, the partial furnace wall tubes 18 are arranged in the row toward the wind box side with the angle α to the furnace side plane and by the influence of the furnace wall tubes 18, the jet flow tends to be biased, as shown by numeral 23, deviating from the jetting directional axis 8. In the first embodiment of the present invention, however, as the furnace wall tubes are arranged differently from the furnace wall tubes 18 of the prior art, the degree of the biasing becomes smaller so that the jet flow is formed as shown by numeral 24.

Thus, in addition to the influence of the flow state near the burner portion being different from the prior art powdery fuel combustion apparatus, there is the influence of the swirling flames 19 in the furnace acting on the jet flow and the jetting direction of the burner jet flow 22 in the present embodiment is presumed to be biased finally by a maximum angle of 15° to 20° from the jetting directional axis 8.

Figure 4:
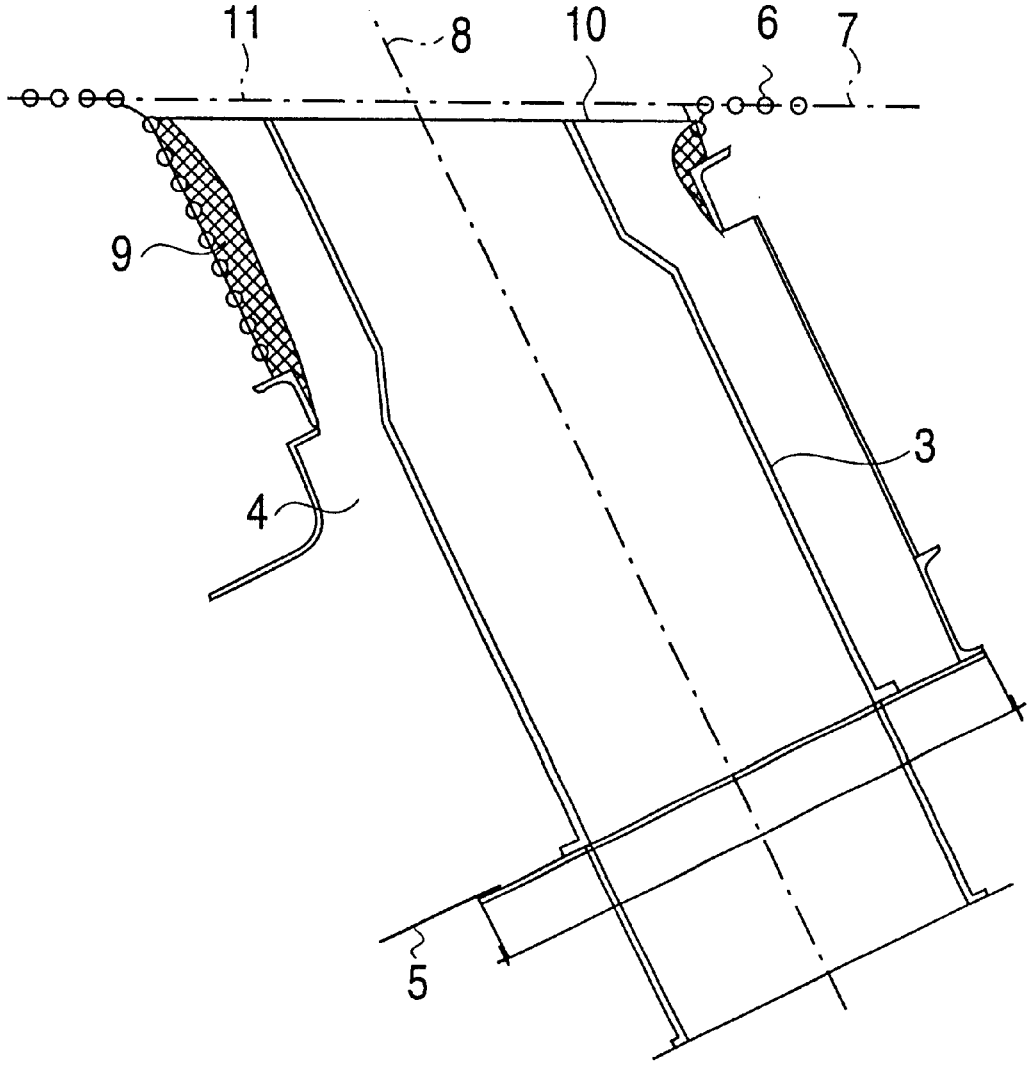
FIG. 4 is a horizontal cross sectional view of a powdery fuel combustion apparatus of a second embodiment according to the present invention.

FIG. 4 is a horizontal cross sectional view of a powdery fuel combustion apparatus of a second embodiment according to the present invention. The present second embodiment is an example constructed using a burner throat 9, in place of the burner nozzle 1 of the first embodiment shown in FIG. 1, in the jetting portion of the combustion assisting air so that the combustion assisting air is jetted into the furnace from the combustion assisting air supply passage 4 via the burner throat 9. In FIG. 4, numeral 10 designates a burner throat opening plane and numeral 11 designates an extension plane of the furnace side plane 7. Numerals 3 to 8 identify the same features as in FIG. 1.

The burner throat 9 may be made of a refractory material or the like and has a cross sectional shape of a right and left non-symmetric shape where a vertical plane passing through the jetting directional axis 8 is the symmetry plane, like in the case of FIG. 1.

The present second embodiment is a case where the burner throat opening plane 10 is not located in the same plane as the furnace side plane 7 as well as the extension plane 11 of the furnace side plane 7 but is located in a parallel plane near both planes 7, 11 and, like in the case of FIG. 1, by employing such a simplified construction, combustion can be effected without the occurrence of the phenomenon that flames impinge on the furnace wall tubes 6 or lick on the furnace wall tubes 6.

It is to be noted that although the illustration shows a case where the burner throat opening plane 10 is located in a plane parallel to the furnace side plane 7 as well as the extension plane 11 of the furnace side plane 7, the burner throat opening plane 10 may also be located in the same plane as these planes.

Figure 5A:
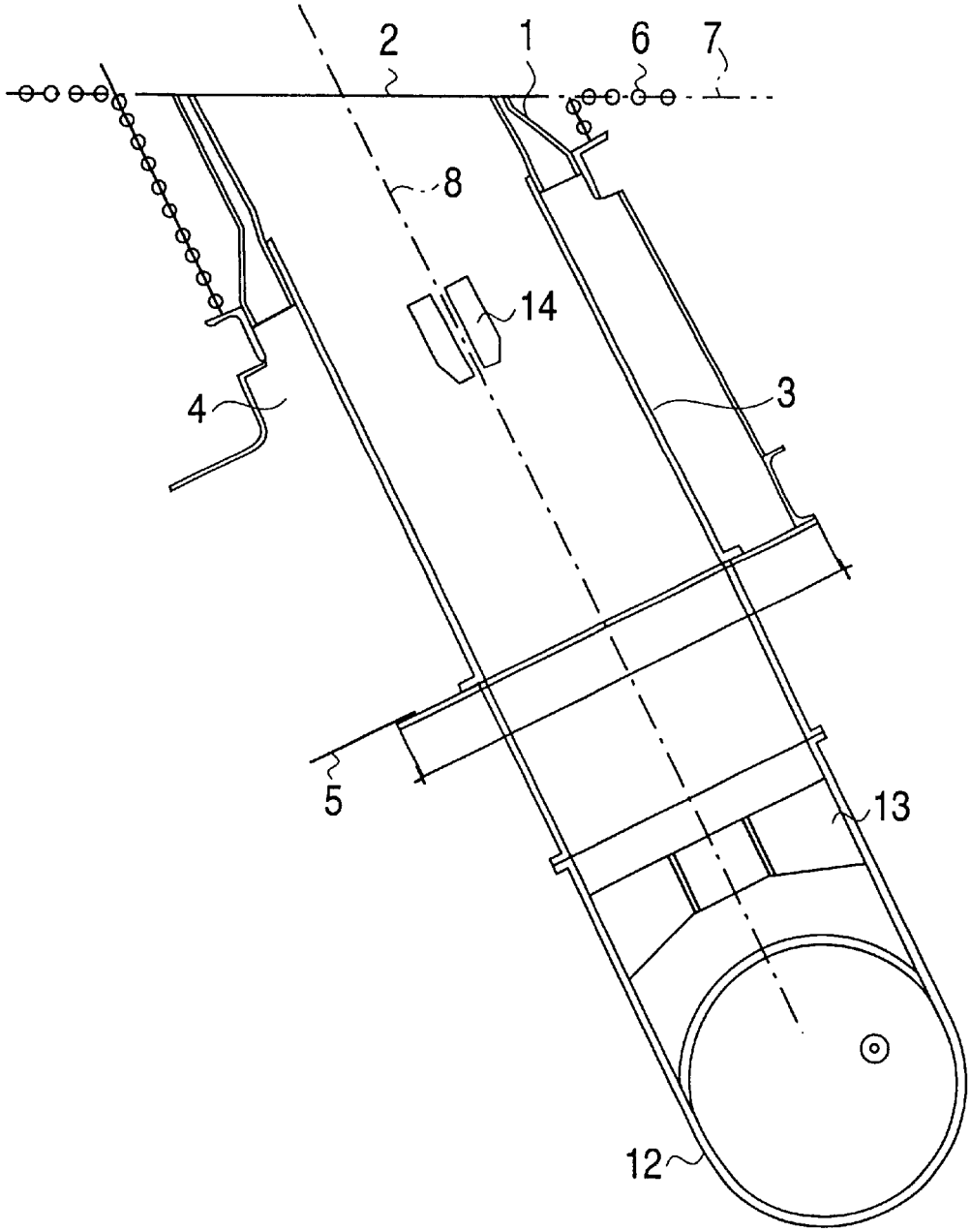
FIGS. 5(*a*)–5(*b*) are horizontal cross sectional views of a powdery fuel combustion apparatus of a third embodiment according to the present invention, wherein FIG. 5(*a*) shows the burner nozzle opening plane coincident with furnace sidewall and FIG. 5(*b*) shows the burner nozzle opening plane parallel to the furnace sidewall.
Figure 5B:
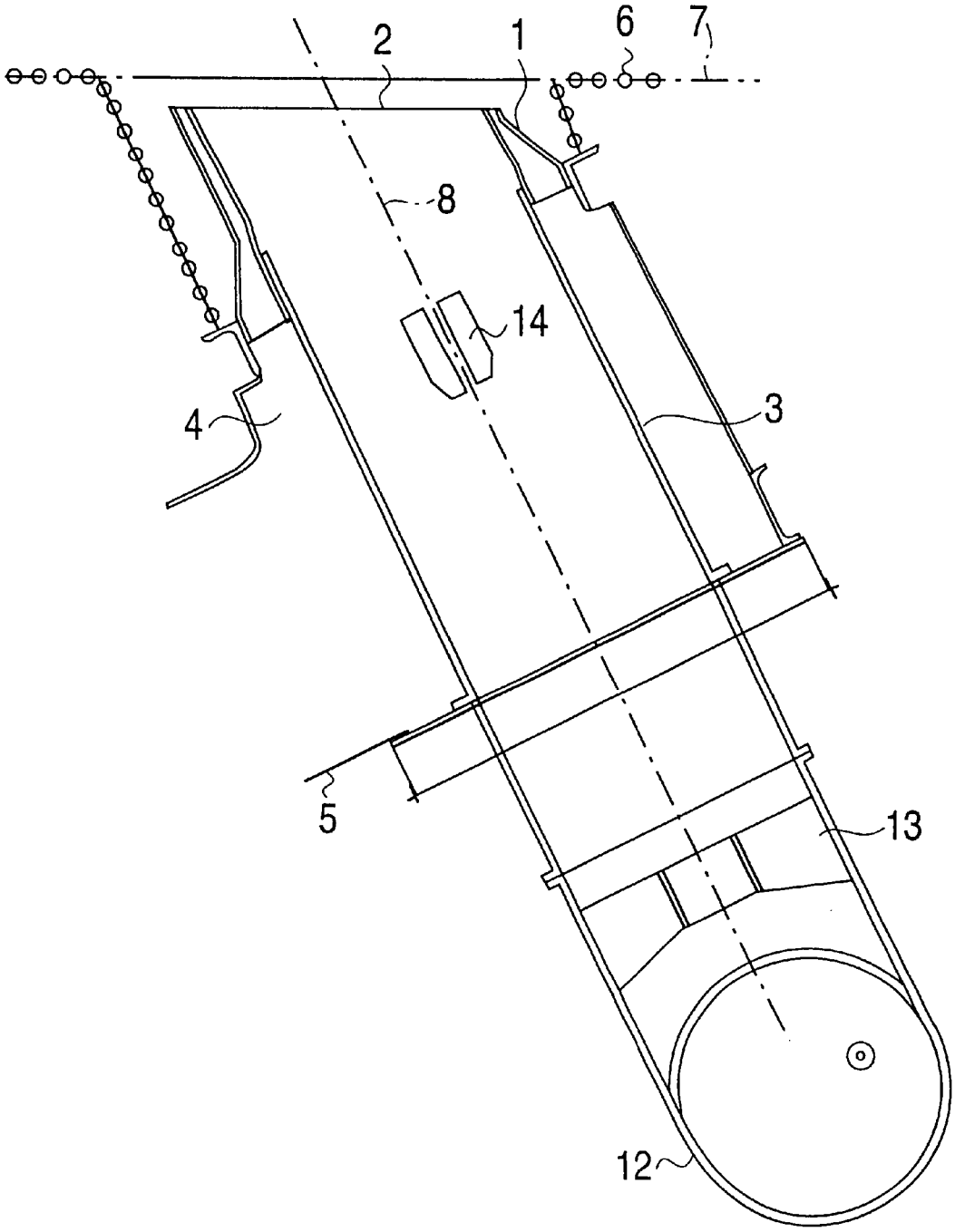

FIG. 5(*a*) is a horizontal cross sectional view of a powdery fuel combustion apparatus of a third embodiment according to the present invention. The present third embodiment is an example constructed such that there are provided a swirler type disperser 13 in a bent portion 12 or on a burner nozzle 1 side of the bent portion 12. The bent portion 12 is located upstream of a portion where the powdery fuel supply pipe 3 is connected to the burner nozzle 1, as well as provided a core type rich/lean separator 14 near the burner nozzle 1 in the powdery fuel supply pipe 3. FIG. 5(*b*) is similar to the apparatus shown in FIG. 5(*a*) except that the opening plane 2 of the tip portion of the burner nozzle 1 is parallel to the furnace side plane 7.

In FIGS. 5(*a*)–(*b*), a mixed flow of a powdery fuel and a carrying air enters the bent portion 12 flowing therein and then a rich/lean distribution of the mixed flow occurs due to a centrifugal force in the bent portion 12, wherein concentration of the powdery fuel is rich on an outer circumferential side of the bent portion 12 and lean on an inner circumferential side thereof. This rich/lean distribution is dispersed by action of the swirler type disperser 13 so that the distribution becomes uniform. Then, the mixed flow, which now has a uniform concentration, is separated into a rich portion or a lean portion by the core type rich/lean separator 14 so that an optimum combustion state may be obtained. The mixed flow is then jetted into the furnace from the burner nozzle 1.

Figure 6:
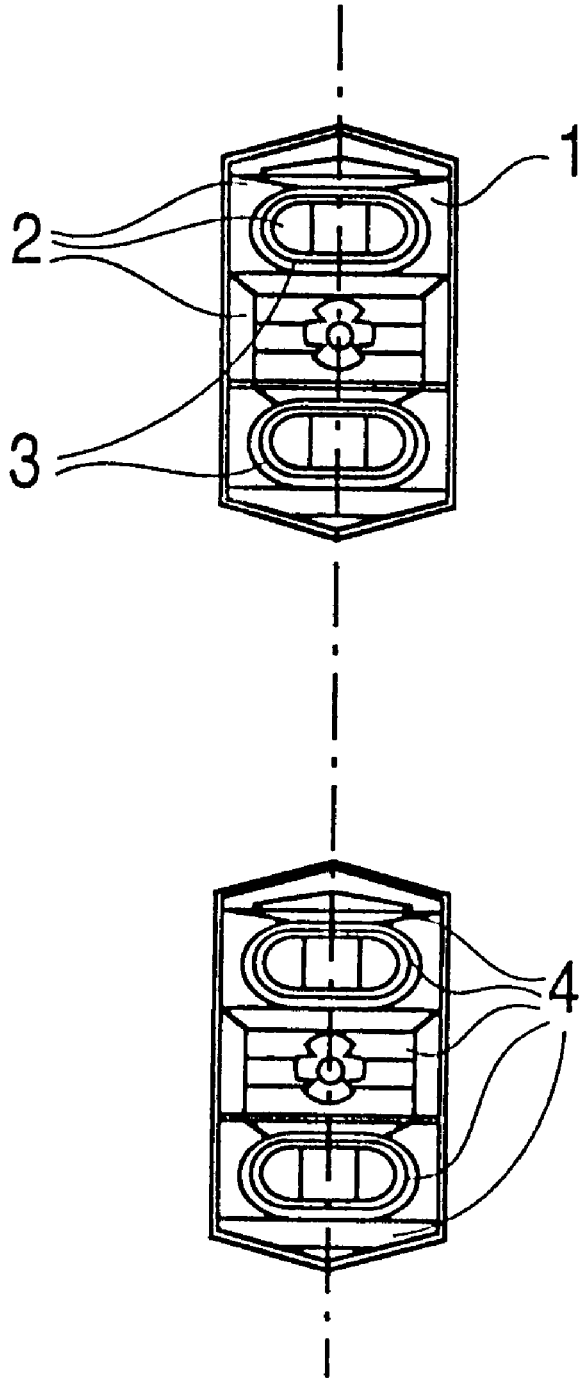
FIG. 6 is a front view, seen from inside of a furnace, of a powdery fuel combustion apparatus of a fourth embodiment according to the present invention.

FIG. 6 is a front view, seen from inside of the furnace, of a powdery fuel combustion apparatus of a fourth embodiment according to the present invention. In the fourth embodiment, a wind box 5 is formed by a plurality of unit wind boxes (two unit wind boxes in the illustration) disposed with spaces therebetween, wherein each of the unit wind boxes has two powdery fuel supply pipes 3 and five combustion assisting air supply passages 4. In FIG. 6, a burner nozzle opening plane 2 assumes a plurality of shapes, such as triangles, rectangles, combined shapes formed by semi-circles and straight lines.

It is understood that while the invention has been described with respect to the embodiments as illustrated, the invention is not limited thereto but embraces various modifications in the illustrated construction within the scope of the appended claims.

According to the present invention, the following effects can be obtained:

(1) Work of the furnace wall tubes and the burner panel is facilitated.

(2) A furnace wall support structure of low cost and simple construction can be employed.

(3) Even in the case of a large capacity burner or a large capacity boiler, access to the surroundings of the furnace wall is facilitated and maintainability thereof can be improved.

(4) The burner nozzle or the burner throat can be located nearer to the furnace interior side as compared with the prior art structures, thereby maintainability thereof can be further improved.

What is claimed is:

1. A combination of a powdery fuel combustion apparatus and a furnace having a vertical sidewall, said combustion apparatus comprising:

a burner nozzle for jetting a mixed flow of powdery fuel, air, and combustion assisting air along a jetting directional axis from a discharge opening that lies in a discharge opening plane;

a powdery fuel supply pipe, connected to said burner nozzle, for supplying the powdery fuel and air; and a wind box connected to said burner nozzle via said powdery fuel supply pipe, said wind box forming a combustion assisting air supply passage that is disposed around said powdery fuel supply pipe, said powdery fuel combustion apparatus being disposed on said furnace sidewall such that a vertical plane passing through the jetting directional axis of said mixed flow forms an oblique angle with said vertical furnace sidewall, wherein said burner nozzle has an asymmetric shape with respect to right and left sides of said burner nozzle with respect to the vertical plane, and said vertical furnace sidewall lies in the discharge opening plane.

2. The combination as claimed in claim 1, wherein said powdery fuel combustion apparatus further comprises:

a swirler disperser disposed in a bent portion of said powdery fuel supply pipe; and a rich/lean separator located in said powdery fuel supply pipe downstream of said swirler disperser with respect to the flow direction through said powdery fuel supply pipe.

3. The combination as claimed in claim 1, wherein said powdery fuel combustion apparatus further comprises:

a disperser disposed in said powdery fuel supply nozzle on a downstream side of a bent portion of said powdery fuel supply pipe with respect to a flow direction through said powdery fuel supply pipe; and a rich/lean separator located in said powdery fuel supply pipe downstream of said disperser with respect to the flow direction through said powdery fuel supply pipe.

4. The combination claimed in claim 1, wherein said wind box comprises a plurality of unit wind boxes, and each of said unit wind boxes comprises two powdery fuel supply pipes and five combustion assisting air supply passages, wherein one of said combustion assisting air supply passages is disposed between said two powdery fuel supply pipes, and four of said combustion assisting air supply passages are disposed so as to open in a double form around each of said two powdery fuel supply pipes, respectively.

5. A combination of a powdery fuel combustion apparatus and a furnace having a vertical sidewall, said combustion apparatus comprising:

a burner throat, connected to said furnace sidewall, for jetting a mixed flow of powdery fuel, air, and combustion assisting air into the furnace along a jetting directional axis from a burner throat discharge opening that lies in a burner throat discharge opening plane;

a powdery fuel supply pipe, connected to said burner throat, for supplying the powdery fuel and air; and a wind box connected to said burner throat nozzle and forming a combustion assisting air supply passage that is disposed around said powdery fuel supply pipe, said powdery fuel combustion apparatus being disposed on said furnace sidewall such that a vertical plane passing through the jetting directional axis of said mixed flow forms an oblique angle with said vertical furnace sidewall, wherein said burner throat has an asymmetric shape with respect to right and left sides of said burner throat relative to the vertical plane, and said vertical furnace sidewall is parallel to the burner throat discharge opening plane.

6. A combination of a powdery fuel combustion apparatus and a furnace having a vertical sidewall, said combustion apparatus comprising:

a burner nozzle for jetting a mixed flow of powdery fuel, air, and combustion assisting air along a jetting directional axis from a discharge opening that lies in a discharge opening plane;

a powdery fuel supply pipe, connected to said burner nozzle, for supplying the powdery fuel and air;

a wind box connected to said burner nozzle via said powdery fuel supply pipe, said wind box forming a combustion assisting air supply passage that surrounds said powdery fuel supply pipe, said powdery fuel combustion apparatus being disposed on said furnace sidewall such that a vertical plane passing through the jetting directional axis of said mixed flow forms an oblique angle with said vertical furnace sidewall, wherein said burner nozzle has an asymmetric shape with respect to right and left sides of said burner nozzle relative to the vertical plane, and the discharge opening plane is parallel to said vertical furnace sidewall;

a swirler disperser disposed in a bent portion of said powdery fuel supply pipe; and a rich/lean separator located in said powdery fuel supply pipe downstream of said swirler disperser with respect to a flow direction through said powdery fuel supply pipe.

7. A combination of a powdery fuel combustion apparatus and a furnace having a vertical sidewall, said combustion apparatus comprising:

a burner nozzle for jetting a mixed flow of powdery fuel, air, and combustion assisting air along a jetting directional axis from a discharge opening that lies in a discharge opening plane;

a powdery fuel supply pipe, connected to said burner nozzle, for supplying the powdery fuel and air;

a wind box connected to said burner nozzle via said powdery fuel supply pipe, said wind box forming a combustion assisting air supply passage that surrounds said powdery fuel supply pipe, said powdery fuel combustion apparatus being disposed on said furnace sidewall such that a vertical plane passing through the jetting directional axis of said mixed flow forms an oblique angle with said vertical furnace sidewall, wherein said burner nozzle has an asymmetric shape with respect to right and left sides of said burner nozzle relative to the vertical plane, and the discharge opening plane is parallel to said vertical furnace sidewall;

a disperser disposed in said powdery fuel supply nozzle on a downstream side of a bent portion of said powdery fuel supply pipe with respect to a flow direction through said powdery duel supply pipe; and a rich/lean separator located in said powdery fuel supply pipe downstream of said disperser with respect to the flow direction through said powdery fuel supply pipe.

8. A combination of a powdery fuel combustion apparatus and a furnace having a vertical sidewall, said combustion apparatus comprising:

a burner nozzle for jetting a mixed flow of powdery fuel, air, and combustion assisting air along a jetting directional axis from a discharge opening that lies in a discharge opening plane;

a powdery fuel supply pipe, connected to said burner nozzle, for supplying the powdery fuel and air; and a wind box connected to said burner nozzle via said powdery fuel supply pipe, said wind box forming a combustion assisting air supply passage that surrounds said powdery fuel supply pipe, said powdery fuel combustion apparatus being disposed on said furnace sidewall such that a vertical plane passing through the jetting directional axis of said mixed flow forms an oblique angle with said vertical furnace sidewall, wherein said burner nozzle has an asymmetric shape with respect to right and left sides of said burner nozzle relative to the vertical plane, wherein said wind box comprises a plurality of unit wind boxes, and each of said unit wind boxes comprises two powdery fuel supply pipes and five combustion assisting air supply passages, wherein one of said combustion assisting air supply passages is disposed between said two powdery fuel supply pipes, and four of said combustion assisting air supply passages are disposed so as to open in a double form around each of said two powdery fuel supply pipes, respectively.

* * * * *